US005228799A

United States Patent [19]

Sondreal

[11] Patent Number: 5,228,799

[45] Date of Patent: Jul. 20, 1993

[54] CONCRETE ROLLER STAMPER

[76] Inventor: Gary W. Sondreal, 621 Plain Hills Dr., Grand Forks, N. Dak. 58201

[21] Appl. No.: 826,362

[22] Filed: Jan. 27, 1992

[51] Int. Cl.[5] ..... E01C 19/26

[52] U.S. Cl. ..... 404/124; 404/131

[58] Field of Search ..... 404/89, 124, 122, 130, 404/131

[56] References Cited

U.S. PATENT DOCUMENTS

| | | | |
|---|---|---|---|
| 3,119,314 | 1/1964 | Schiel, Jr. | 404/124 |
| 3,547,014 | 12/1970 | Austin | 404/131 X |
| 3,832,079 | 8/1974 | Moorhead | 404/72 |
| 3,910,712 | 10/1975 | Guerin | 404/131 X |
| 3,910,738 | 10/1975 | Chandler et al. | 404/124 X |
| 4,105,354 | 8/1978 | Bowman | 404/72 |
| 4,702,640 | 10/1987 | Allen | 404/131 X |
| 5,011,325 | 4/1991 | Antonioli | 404/6 |

*Primary Examiner*—William P. Neuder

*Attorney, Agent, or Firm*—Hill, Steadman & Simpson

[57] ABSTRACT

A device for imprinting patterns on concrete is formed of a lightweight cylindrical member with a raised grid pattern thereon for forming the impressions. The cylindrical member is provided with a handle which projects laterally of the cylindrical member to permit the cylindrical member to be guided by a person walking alongside the cylinder. A cylinder can be used immediately after a concrete slab has been poured and smoothed.

20 Claims, 2 Drawing Sheets

FIG. 4
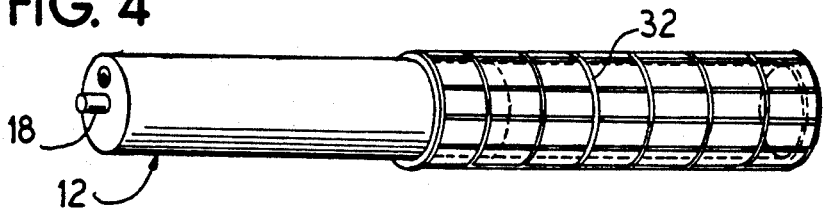
FIG. 5
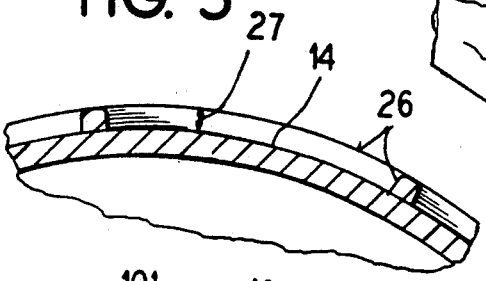
FIG. 6
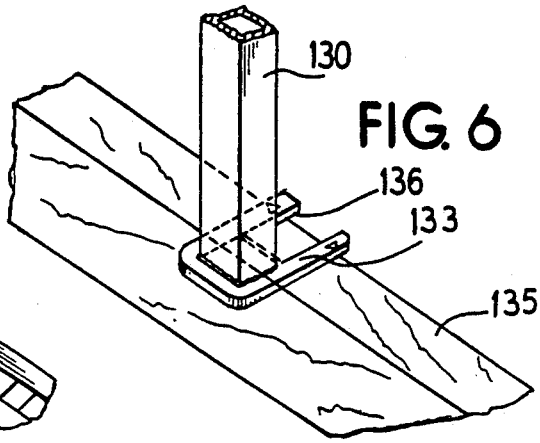
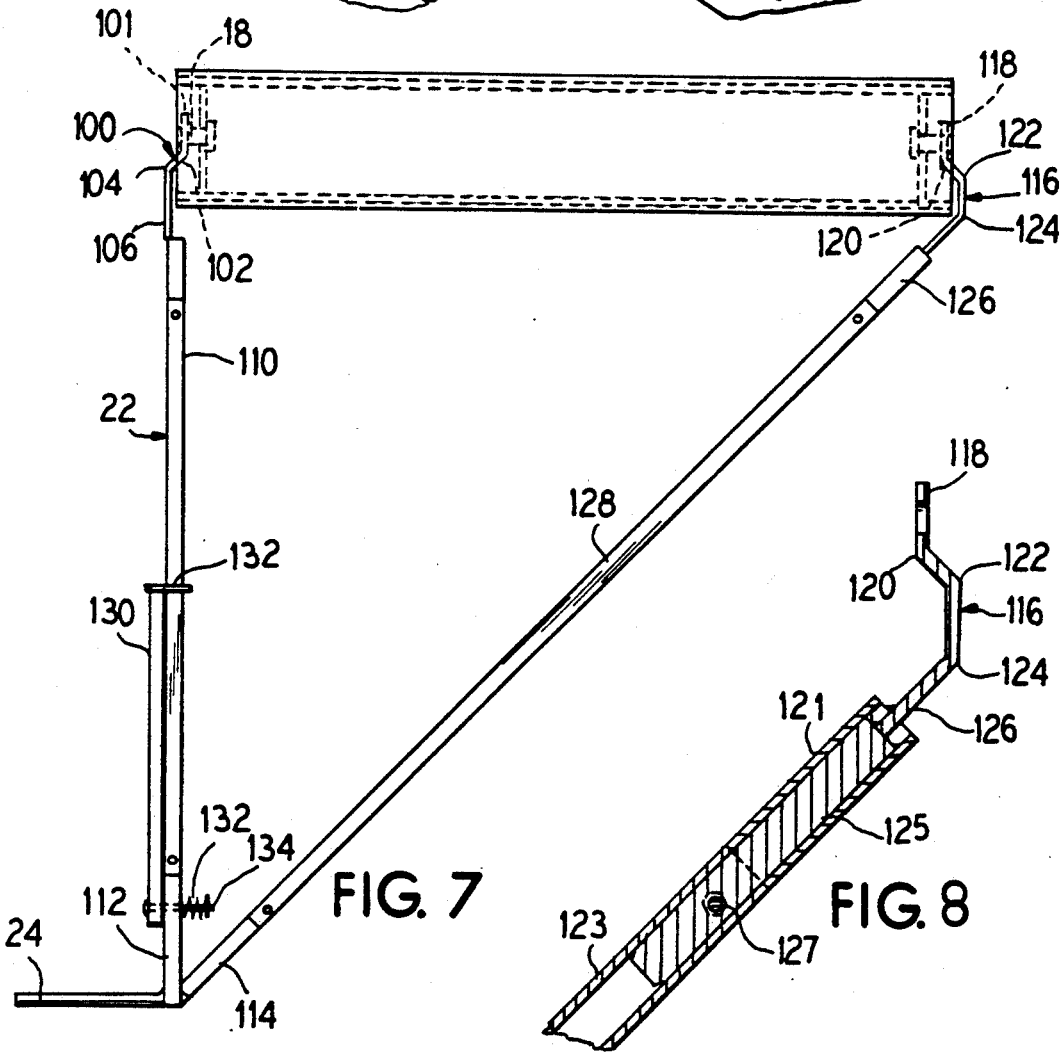
FIG. 7
FIG. 8

CONCRETE ROLLER STAMPER

BACKGROUND OF THE INVENTION

The present invention relates to devices for imprinting various patterns in concrete that is still wet and soft after a slab has been freshly poured and smoothed.

In the past, imprinting has been accomplished in different ways. The most popular way is to imprint by hand with various types of flat forms that are pressed into the concrete before it has set. These forms vary in size, but are generally small enough for one man to handle.

There are a number of drawbacks to any hand-forming method. One drawback is that it is very time consuming in that the form has to be pressed into un-set concrete by the worker, then the form has to be picked up and realigned with the imprint just made. This process is repeated until the entire slab has been imprinted.

A second drawback of such a hand-forming method is caused by the time consumptive method described above. A large slab of concrete would have to be made in several pours since the length of time it would take to imprint by hand would allow the slab to set too hard before the slab could be finished with the imprinting process.

There are some known repeating pattern imprinting devices. A first such device is disclosed in U.S. Pat. No. 3,832,079. The device disclosed in that patent has some major drawbacks which make it impractical, if not impossible, to use. First of all, the device includes a motorized tractor vehicle which must be driven on and over the top of a poured slab. In order to accomplish this, because of its heavy weight, the operator must wait for the slab to set up hard enough to support the device. Once the concrete has set to this point, any grid forced into it would cause bulged, torn, or broken edges on the concrete surface where each grid penetrates. This will happen even if a plastic buffer or releasing agent is used as suggested in that disclosure. Because of the weight of the vehicle, this device cannot be used on soft concrete without the vehicle sinking below the surface.

A second type of repeat pattern imprinter is disclosed in U.S. Pat. No. 4,105,354. This device has a number of significant drawbacks as well. First, it is stated in the disclosure that the imprint should be approximately three quarters of an inch deep. An imprint this deep would weaken the slab. To make up for the weakening of the slab, the entire slab would have to almost one inch thicker. The device disclosed in this patent is a large wheel or cylinder which is large enough to accommodated a worker in a walking position therein. The workers are to walk and grasp interior portions of the cylinder to cause it to roll along a freshly poured slab. Although the disclosure suggests that workmen can direct this wheel from the inside, the fact is that once inside the wheel, the worker can only make the device go forward or backward. There is no way for the worker to steer right or left. The worker can therefore only go where the wheel takes him. If the worker is to steer, he must step outside of the wheel and apply force on the side of the wheel.

Further, the disclosed device has to be very large in order to a man to fit inside. Therefore, even if it were built out of aluminum, which would be quite costly, its size and weight would make it very awkward to handle. Further, because the grid is open and due to the extreme weight of the wheel and workmen inside of it, there is no way to control the device's depth on a slab of freshly poured and still soft concrete. A device of this size would sink beyond the surface of the concrete, even without any workers in it.

It would therefore be necessary for the concrete to at least partially set before such a device could be used. Any device that requires the workers to wait for the concrete to become partially set is not practical. Because timing is so critical in the setting of a concrete slab, waiting for the concrete to become partially set would be a guessing game, even for a person with experience. Also, the workmen would have to remain on the job site waiting for the concrete to partially set. If the timing is off, the concrete would either be too soft, thus causing the device to sink below the surface, or if the concrete becomes too hard, the device will not provide the necessary imprint, even with a number of people within the wheel.

Since this device can be used only when the concrete has partially set, there is a danger of getting bulged, torn, or broken edges at each grid penetration on the concrete surface. The cost of having workmen wait on a job site to permit the concrete to partially set up would become quite expensive.

Finally, even if this device could be used, with a person inside, on freshly poured concrete, there would be a very messy drawback. Because of the open nature of the grid, concrete is going to be carried up and over by the open grid and dropped through onto the workmen inside. Even if the workmen were to be wearing protective clothing, there would still be a considerable mess generated by this device.

Therefore, it would be an improvement in the art if there were provided a device which could be used to imprint various impressions on freshly poured concrete in a fast and efficient manner, without waiting for the concrete to set up and to allow the users of the imprinting device to guide the device in a controlled fashion.

SUMMARY OF THE INVENTION

The present invention provides a lightweight, drum-like cylinder having grid members projection from an outer surface of the cylinder to make the desired impressions in concrete. The cylinder has a handle member attached to an axle of the cylinder, and the handle extends laterally beyond an end of the cylinder to permit a worker to walk beside the cylinder as it is rolled along freshly poured concrete in order to control and guide the cylinder during the imprinting process. Since the cylinder is light in weight, it can be used immediately after the concrete has been poured and smoothed, and there is no requirement that the concrete be permitted to partially set. Preferably, the cylinder is relatively small in diameter, that is in the range of 8 to 24 inches. The cylinder may be formed in a water-tight manner and provided with a sealable plug in order to permit the introduction and draining of a liquid into and from an interior of the cylinder to selectively increase the weight as necessary or desirable.

BRIEF DESCRIPTION OF THE DRAWINGS

FIG. 4 is a perspective view of partially assembled cylinder and grid members.

FIG. 5 is an enlarged partial end view of the cylinder and grid.

FIG. 6 is a perspective view of a bottom end of a guide member.

FIG. 7 is plan view of the device.

FIG. 8 is a detailed view of a connecting portion of the handle member.

DESCRIPTION OF THE PREFERRED EMBODIMENTS

Figure 1:
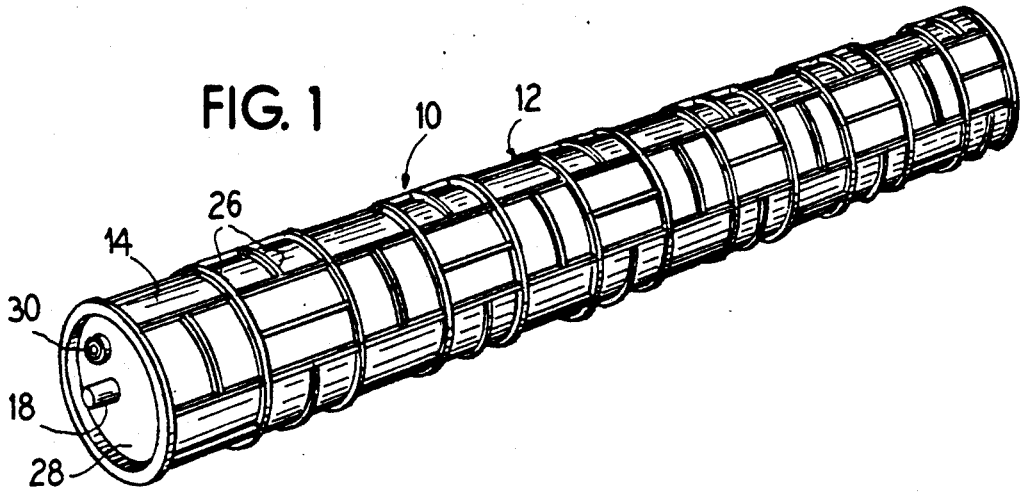
FIG. 1 is perspective view of a cylindrical member for imprinting patterns on concrete.
Figure 2:
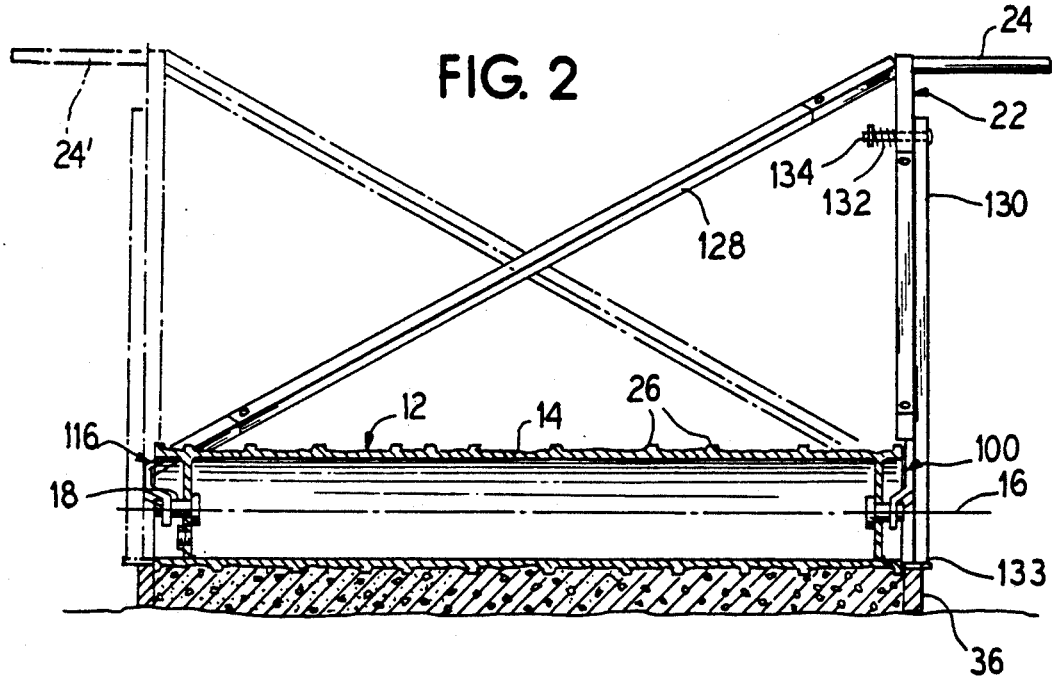
FIG. 2 is an end elevational view of the roller of FIG. 1 in an imprinting process.
Figure 3:
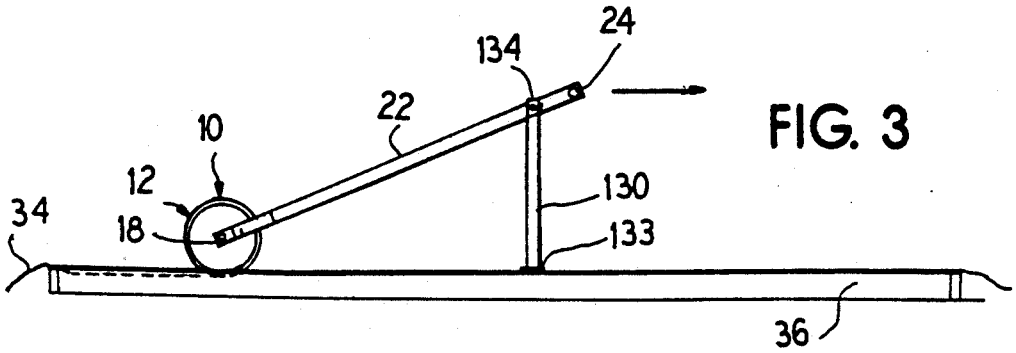
FIG. 3 is a side elevational view of the arrangement of FIG. 2.

A device for imprinting concrete is shown generally at 10 in FIGS. 1–3. The device comprises a cylindrical member 12 which is defined by a cylindrical wall 14 formed about a longitudinal axis 16. The cylindrical member preferably has a diameter in the range of 8 to 24 inches.

At least one, and preferably two axle members 18 are attached to and extend from the cylindrical member 12 along the axis 16 of the cylindrical member 12. At least one handle member 22 is attached to the axle 18 such that the handle 22 is free to rotate relative to the cylindrical member 12. The handle member 22 has a manual grasping portion 24 which extends laterally beyond at least one of the ends 20 of the cylindrical member 12. As suggested in phantom in FIG. 2, a second manual grasping portion 24' can be provided such that there will be a manual grasping portion extending laterally beyond both ends 20 of the cylindrical member 12.

In a preferred arrangement the handle member 22 is comprised of a number of separate elements as best seen in FIG. 7. A first element 100 is a connection member which attaches at a leg 101 to the axle 18, which may be recessed longitudinally inward of the end 20 of the cylindrical wall. The connection member 100 has a pair of opposed bends 102, 104 and a leg portion 106 which is parallel to the leg 101 connected to the axle 18. An extension bar 110, which can be varied in length to accommodate various roller sizes, is removably attached to the projecting leg 106 and is substantially parallel to and roughly coplanar with the end 20. The manual grasping portion 24 has a first connecting leg 112 formed at approximately 90° to the manual grasping portion 24 which can be selectively connected to the extension member 110. A second leg 114 extends at an angle toward the other end 20 of the roller. A second connection member 116 has a first leg 118 which is connected to the axle 18 and has a series of three bends 120, 122 and 124 ending with a connection leg 126 directed toward the manual grasping member 24. An extension member 128 is connected between the connection leg 126 and the angle leg 114 and it also is variable in length to accommodate different length cylindrical members.

In a preferred arrangement the various portions of the handle members are formed as tubes 121, 123 with smaller dimensioned tubes 125 carried therein at the connecting portions (FIG. 8), the smaller dimension tubes 125 extending beyond the length of the tube 121 to which it is permanently affixed to be received inside the connecting tube 123. Appropriate fastening means 127 such as bolts or quick connection devices could be used to secure the various connecting members together.

A depending guide member 130 is secured to the connecting leg 112 adjacent to the manual grasping member 24 and is biased by a spring 132 to be held against the arm 112. The guide member 130 is free to pivot about a connecting pin 134 on which the spring 132 is carried. The guide member 130 depends downwardly from arm 112 to act as a visual guide for workers operating the roller by having a plate member 133 overlying a form 135 used to hold the concrete in place while the concrete is setting (FIG. 6).

The plate member 133 may either be permanently marked, or marked at the time of use so it can be lined up with an edge of the form 134. The guide member 130 may also be secured in a non-working position along extension arm 110 by a recess 136 in the plate member engaging around the extension arm 110.

The axle members 18 may be fixed relative to the cylindrical member 12 to rotate therewith. In such an arrangement, the handle member 22 will be rotatably mounted on the axle member. To fixedly mount the axle members 18 on the cylindrical member 12, there may be provided a pair of end plates 28 which are secured to each end 20 of the cylindrical member 12. The axle members 18 can then be secured to each of the end plates.

The end plates 28 may be made solid and may be sealed to the ends 20 of the cylindrical wall 14 in a water-tight manner. One or more removable and resealable plug members 30 may be provided in the end plates 28 to permit the introduction and draining of a liquid into and from an interior of the cylinder.

The outer surface of the cylindrical wall 14 can either be smooth as appears in FIG. 1, or textured as appears in FIG. 2 in order to give a final desired look to the concrete.

The device also includes grid members 26 which project from an outer surface of the cylindrical wall 14. The grid members can be arranged in any desired repeating pattern. As best seen in FIG. 5, it is desirable that the grid members 26 project from the outer surface of the cylindrical wall 14 a distance 27 less than 0.75 inches and preferably approximately 0.375 inches.

The grid members 26 may be secured directly to the cylindrical wall 14 in a permanent fashion by permanently attaching them thereto subsequent to the formation of the cylindrical wall. If the cylindrical wall is formed of metal, the grid members, if also metal, can be secured such as by welding. Other types of fastening arrangements can also be utilized.

The grid members 26 could also be formed integrally with the cylindrical wall 14. Such an arrangement would be desirable, particularly if the cylindrical wall is made of plastic material.

The grid members 26 could also be joined together as an integral unit 32 separate from the cylindrical member 12 as shown in FIG. 4. The grid member unit 32 would then form a sleeve which could be slipped onto and removed from the cylindrical member 12 in order to permit a single cylindrical member to be used in conjunction with a number of different grid patterns. The grid member sleeve 32 would be secured to the cylindrical member 12 with appropriate fasteners.

Because of the lightweight nature of this imprinting device, it can be used immediately after the concrete has been poured and smoothed. It is preferably that a plastic film 34 or other release agent is utilized between the concrete slab and the device 10 in order to prevent wet concrete from sticking to the cylindrical member 12.

Generally a cylindrical member 12 is selected which has an axial length equal to the width of the poured slab such that the cylindrical member 12 will fit just inside of forms 36 used to hold the concrete in place while it sets.

By using a cylindrical member 12 of a width equal to the poured slab, only a single pass over the slab by the cylindrical member 12 is required. This avoids the necessity of precisely aligning adjacent patterns. To make the imprint, the workers grasp the manual grasping portion 24 of the handle 22 to roll the cylindrical member 12 along the length of the freshly poured slab. With slabs that are wider, it may be desirable that the handle member 22 be provided with both manual grasping portions 24,24' in order to allow persons on each end of the roller to assist in guiding of the roller.

It has been found that cylinders with a diameter of approximately 8 inches or less could be used, however, the technique for using such small diameter cylinders is more critical in that it is more likely for the cylinder to leave a lateral concave depression in the fresh concrete if the movement of the cylinder along the length of the slab is not smooth and continuous. Rollers with a diameter greater than 24 inches, although functional, do not provide any additional benefits and are more expensive and unwieldy, particularly in storage and transportation.

While preferred embodiments have been shown, modifications and changes may become apparent to those skilled in the art which shall fall within the spirit and scope of the invention. It is intended that such changes be covered by the attached claims.

I claim as my invention:

1. A device for imprinting concrete comprising:

a cylindrical member defined by a solid cylinder wall having a longitudinal axis;

a pair of end plates secured to ends of said cylindrical wall;

axle members extending perpendicular to said end plates, coaxial with said axis of said cylindrical member;

at least one handle member rotatably attached to said cylindrical member at said axle members, said handle member having a manual grasping portion extending laterally beyond an end of said cylindrical member;

a guide member attached to said handle member;

said guide member having a portion carrying visible indicia thereon movable to a position in close proximity to said concrete; and grid members projecting from an outer surface of said cylindrical wall.

2. A device according to claim 1, wherein a diameter of said cylindrical member is in the range of 8 to 24 inches.

3. A device according to claim 1, wherein said end plates seal the ends of said cylindrical member in a water tight manner.

4. A device according to claim 3, wherein a removable and sealable plug is provided in at least one end plate to permit the introduction and draining of a liquid into and from an interior of said cylindrical member.

5. A device according to claim 1, wherein said grid members are removable from said cylindrical member.

6. A device according to claim 1, wherein said grid members are permanently secured to said cylindrical member.

7. A device according to claim 1, wherein said grid members are formed integrally with said cylindrical wall.

8. A device according to claim 1, wherein said cylindrical wall is made of metal.

9. A device according to claim 1, wherein said cylindrical wall is made of plastic.

10. A device according to claim 1, wherein said grid members have a height above the surface of said cylindrical wall of less than 0.75 inches.

11. A device according to claim 10, wherein said grid members have a height above the surface of said cylindrical wall of about 0.375 inches.

12. A device according to claim 1, wherein said surface of said cylindrical wall is smooth.

13. A device according to claim 1, wherein said surface of said cylindrical wall is textured.

14. A device according to claim 1, wherein said handle member projects laterally from both ends of said cylindrical member to provide a manual grasping area at each end of said cylindrical member.

15. A device for imprinting concrete comprising:

a cylindrical member defined by a peripheral cylindrical wall having a longitudinal axis;

at least one axle member attached to and extending from said cylindrical member along said axis and projecting beyond each end thereof;

at least one handle member attached to said axle member to rotate relative to said cylindrical member, said handle member having a manual grasping portion extending laterally beyond at least one of said ends of said cylindrical member;

a guide member attached to said handle member;

said guide member having a portion carrying visible indicia thereon movable to a position in close proximity to said concrete; and grid members projecting from an outer surface of said cylindrical wall.

16. A device according to claim 15, wherein said axle member is fixed relative to said cylindrical member and rotates therewith.

17. A device according to claim 15, wherein a pair of end plates are secured to said cylindrical member and said at least one axle member comprises two axle members, one secured to each of said end plates.

18. A device for imprinting concrete comprising:

a cylindrical member defined by a solid peripheral cylindrical wall having a longitudinal axis and a diameter in the range of 8 to 24 inches;

a pair of end plates secured to ends of said cylindrical wall in a water tight manner;

a removable and resealable plug member provided in at least one of said end plates to permit the introduction and draining of a liquid into and from an interior of said cylinder;

axle members extending outwardly perpendicular to said end plates, coaxial with said axis of said cylindrical member;

at least one handle member rotatably attached to said cylindrical member at said axle members, said handle member having a manual grasping portion extending laterally beyond an end of said cylindrical member; and an extension portion extending from one of said axle members to said manual grasping portion;

a guide member attached to said handle member;

said guide member having a portion carrying visible indicia thereon pivotable to a position in close proximity to said concrete; and grid members projecting from an outer surface of said cylindrical wall.

19. A device according to claim 18, wherein said grid members are removable from said cylindrical member.

20. A device according to claim 18, wherein said grid members are permanently secured to said cylindrical member.

* * * * *